US010094558B2

(12) United States Patent
Park et al.

(10) Patent No.: US 10,094,558 B2
(45) Date of Patent: Oct. 9, 2018

(54) BURNER

(71) Applicant: LG ELECTRONICS INC., Seoul (KR)

(72) Inventors: Janghee Park, Seoul (KR); Yongki Jeong, Seoul (KR); Jaebeom Lim, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 433 days.

(21) Appl. No.: 14/867,168

(22) Filed: Sep. 28, 2015

(65) Prior Publication Data

US 2016/0178210 A1 Jun. 23, 2016

(30) Foreign Application Priority Data

Dec. 17, 2014 (KR) ..... 10-2014-0182328

(51) Int. Cl.
*F24C 3/08* (2006.01)
*F23D 14/84* (2006.01)
*F23D 14/06* (2006.01)

(52) U.S. Cl.
CPC ..... *F23D 14/84* (2013.01); *F23D 14/06* (2013.01); *F24C 3/085* (2013.01); *F23D 2203/1026* (2013.01); *F23D 2900/00003* (2013.01); *F23D 2900/14062* (2013.01); *F23D 2900/14063* (2013.01)

(58) Field of Classification Search
CPC .. F23D 14/84; F23D 14/06; F23D 2203/1026; F23D 2900/14062; F23D 2900/00003; F23D 2900/14063; F24C 3/085
USPC ..... 126/39 E
See application file for complete search history.

(56) References Cited

U.S. PATENT DOCUMENTS

2001/0010897 A1* 8/2001 Dane ..... F23D 14/065 431/266
2009/0205630 A1* 8/2009 Pottenger ..... F23D 14/06 126/39 E
2009/0320823 A1* 12/2009 Padgett ..... F23D 14/06 126/39 E
2011/0143295 A1* 6/2011 Fowler ..... F23D 14/06 431/285

FOREIGN PATENT DOCUMENTS

EP 2551589 A2 * 1/2013 ..... F23D 14/06

* cited by examiner

*Primary Examiner* — Alfred Basichas
(74) *Attorney, Agent, or Firm* — Dentons US LLP

(57) ABSTRACT

Provided is a burner including a burner head configured to receive a mixed gas; and a burner cap configured to cover the burner head, wherein the burner head includes an outer wall having a plurality of first flame holes at which flame are generated, an inner wall spaced from the outer wall and having a plurality of second flame holes at which flame are generated, and a mixed gas chamber formed between the outer wall and the inner wall, and a staying guide provided at an inner circumferential surface of the inner wall and configured to allow the mixed gas flowing from the mixed gas chamber to be stayed thereon.

18 Claims, 7 Drawing Sheets

BURNER

CROSS-REFERENCE TO RELATED APPLICATION(S)

This application claims priority under 35 U.S.C. § 119 to Korean Application No. 10-2014-0182328, filed in Korea on Dec. 17, 2014, whose entire disclosure is hereby incorporated by reference.

BACKGROUND

1. Field

A burner is disclosed herein.

2. Background

Generally, a burner serves to directly heat food or a container filled with the food using a flame generated when burning a gas.

FIG. 7 is a perspective view of a burner according to the related art.

Referring to FIG. 7, the burner according to the related art includes a burner head 50 having a plurality of flame holes, and burner caps 61 and 62 which cover the burner head 50.

The burner head 50 includes an outer burner head 52, and an inner burner head 53 which is located at an inside of the outer burner head 52.

The burner caps 61 and 62 includes an outer cap 61 which covers an upper side of the outer burner head 52, and an inner cap 62 which covers the inner burner head 53.

In the case of such a burner, a flame should be spread between the outer burner head 52 and the inner burner head 53.

In the case of the burner according to the related art, a slit 63 which forms a flame spread passage may be provided at the outer cap 61 to spread the flame between the outer burner head 52 and the inner burner head 53.

A mixed gas in which air and a gas are mixed may exist in the slit 63, and thus, when the flame in one of the outer burner head 52 and the inner burner head 53 is extinguished, the flame may be generated again by receiving the flame of the other burner head.

However, according to the burner in the related art, the slit may be clogged with food or slop in the process of using the burner. In this case, there is a problem in that it is impossible to spread the flame through the slit.

In this case, there is another problem in that the unburned mixed gas leaks from one of the outer burner head 52 and the inner burner head 53.

SUMMARY

The present disclosure is directed to a burner which is capable of smoothly spreading a flame.

According to an aspect of the present disclosure, there is provided a burner including a burner head configured to receive a mixed gas; and a burner cap configured to cover the burner head, wherein the burner head includes an outer wall having a plurality of first flame holes at which flame are generated, an inner wall spaced from the outer wall and having a plurality of second flame holes at which flame are generated, and a mixed gas chamber formed between the outer wall and the inner wall, and a staying guide provided at an inner circumferential surface of the inner wall and configured to allow the mixed gas flowing from the mixed gas chamber to be stayed thereon.

The details of one or more embodiments are set forth in the accompanying drawings and the description below. Other features will be apparent from the description and drawings, and from the claims.

BRIEF DESCRIPTION OF THE DRAWINGS

Embodiments will be described in detail with reference to the following drawings in which like reference numerals refer to like elements, and wherein.

DETAILED DESCRIPTION

Reference will now be made in detail to the embodiments of the present disclosure, examples of which are illustrated in the accompanying drawings.

In the following detailed description of the preferred embodiments, reference is made to the accompanying drawings that form a part hereof, and in which is shown by way of illustration specific preferred embodiments in which the invention may be practiced. These embodiments are described in sufficient detail to enable those skilled in the art to practice the invention, and it is understood that other embodiments may be utilized and that logical structural, mechanical, electrical, and chemical changes may be made without departing from scope of the invention. To avoid detail not necessary to enable those skilled in the art to practice the invention, the description may omit certain information known to those skilled in the art. The following detailed description is, therefore, not to be taken in a limiting sense.

Also, in the description of embodiments, terms such as first, second, A, B, (a), (b) or the like may be used herein when describing components of the present disclosure. Each of these terminologies is not used to define an essence, order or sequence of a corresponding component but used merely to distinguish the corresponding component from other component(s). It should be noted that if it is described in the specification that one component is "connected," "coupled" or "joined" to another component, the former may be directly "connected," "coupled," and "joined" to the latter or "connected", "coupled", and "joined" to the latter via another component.

Figure 1:
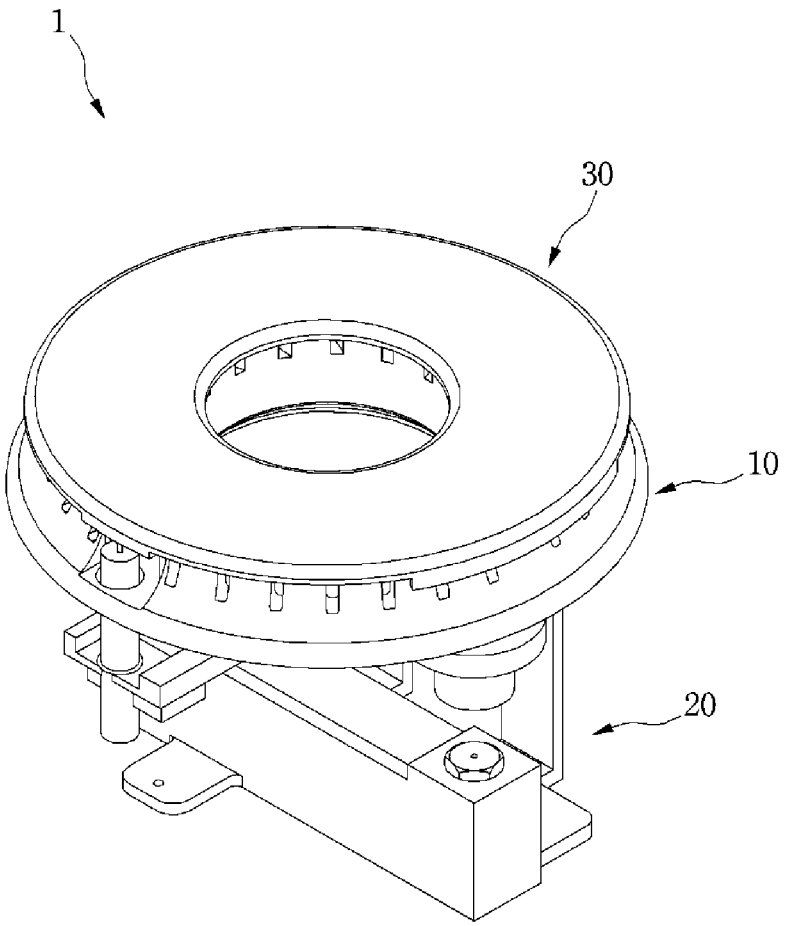
FIG. 1 is a perspective view of a burner according to an embodiment of the present disclosure.
Figure 2:
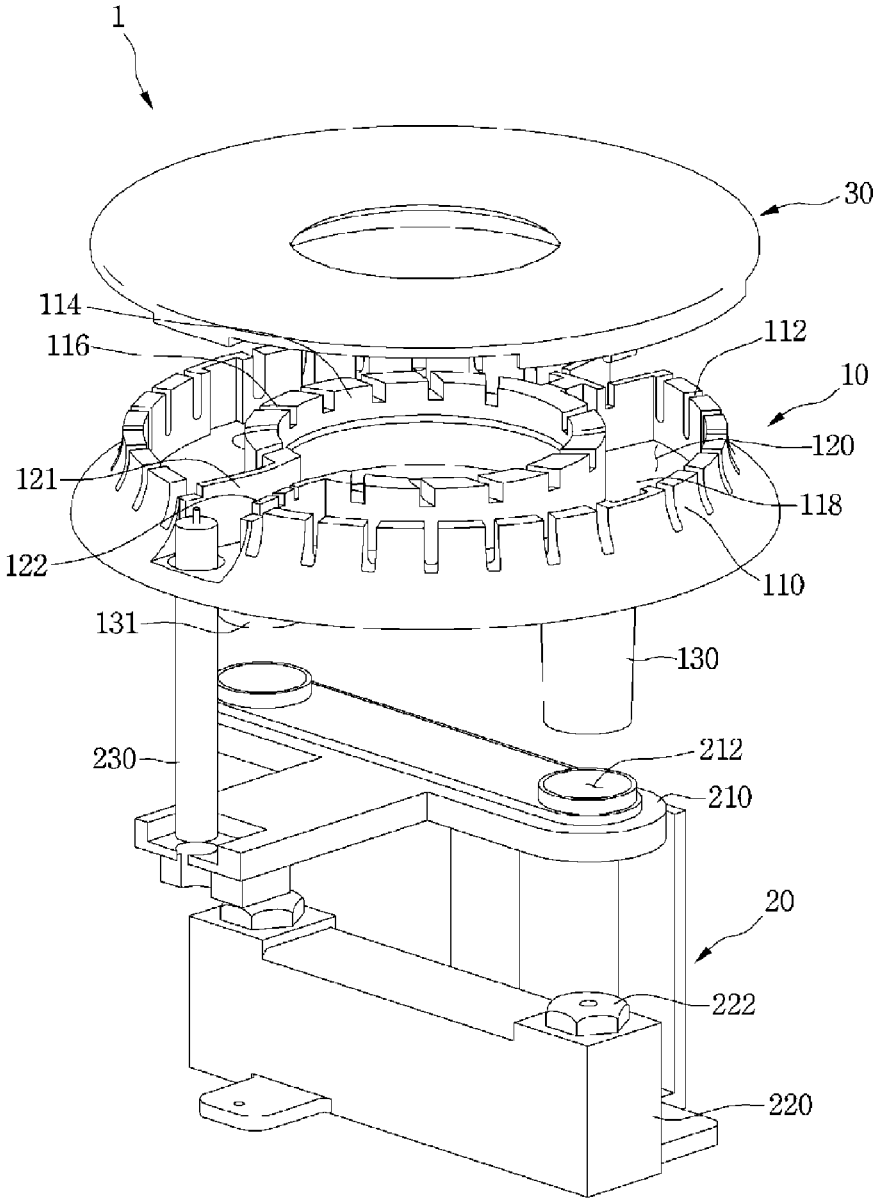
FIG. 2 is an exploded perspective view of the burner of FIG. 1.

FIG. 1 is a perspective view of a burner according to an embodiment of the present disclosure, and FIG. 2 is an exploded perspective view of the burner of FIG. 1.

Referring to FIGS. 1 and 2, the burner according to the embodiment of the present disclosure may include a burner head 10 having a plurality of flame holes through which a flame is discharged, and a burner body 20 which supports the burner head 10, and a burner cap 30 which is seated on an upper side of the burner head 10.

The burner 1 may further include an ignition part 230 which ignites a mixed gas of air and a gas supplied to the burner head 10.

A burner body 20 may include a head support part 210 which supports the burner head 10, and a gas supply part 220 which is connected with the head support part 210.

The head support part 210 may include an opening 212 through which mixed gas supply pipes 130 and 131 may pass.

The gas supply part 220 may receive the gas and may supply the gas to the burner head 10. The gas supply part 220 may have a plurality of nozzles 222.

Also, the gas supply part 220 may support the ignition part 230.

The burner head 10 may include the mixed gas supply pipes 130 and 131 which supply the mixed gas to the burner head 10. The mixed gas supply pipes 130 and 131 may pass through the opening 212 formed at the head support part 210 of the burner body 20. While the burner head 10 is seated on the head support part 210 of the burner body 20, the mixed gas supply pipes 130 and 131 are spaced from the nozzles 222 provided at the gas supply part 220.

Therefore, when the gas is sprayed from the nozzles 222, air around the mixed gas supply pipes 130 and 131 is introduced into the mixed gas supply pipes 130 and 131 together with the gas.

Figure 3:
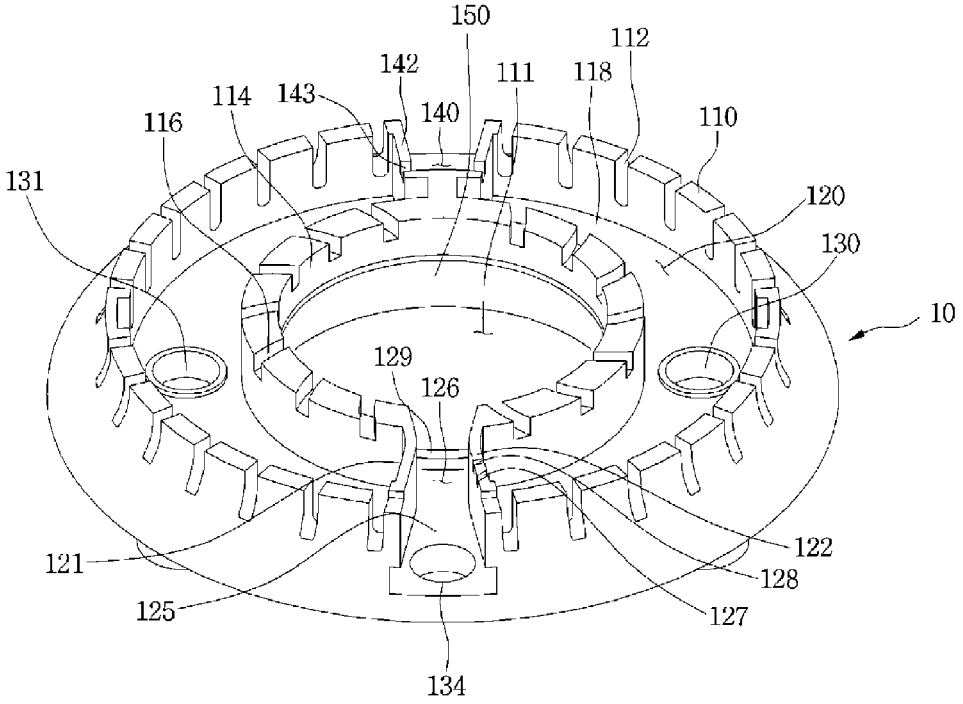
FIG. 3 is a perspective view of a burner head according to the embodiment of the present disclosure.
Figure 4:
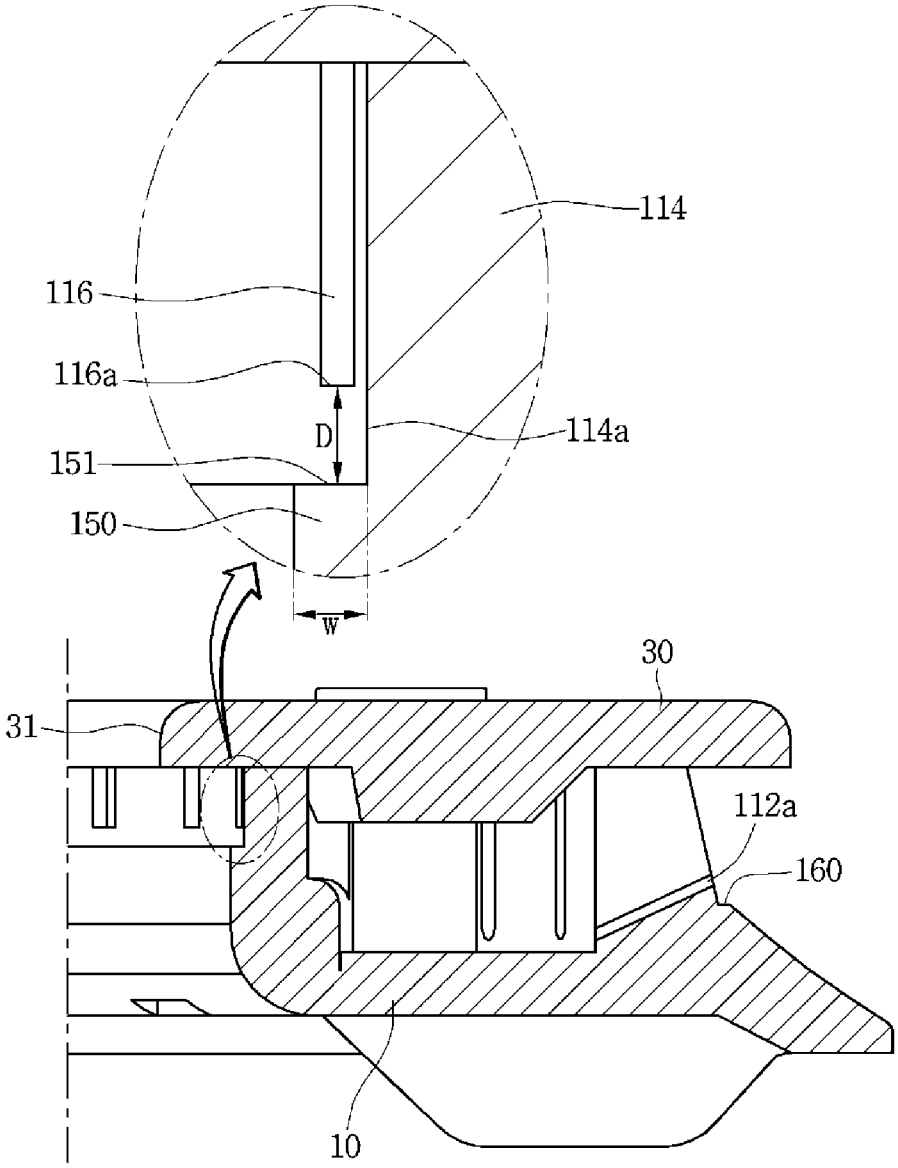
FIG. 4 is a cross-sectional view illustrating a state in which a burner cap is seated on the burner head according to the embodiment of the present disclosure.

FIG. 3 is a perspective view of the burner head according to the embodiment of the present disclosure, and FIG. 4 is a cross-sectional view illustrating a state in which the burner cap is seated on the burner head according to the embodiment of the present disclosure.

Referring to FIGS. 2 to 4, the burner head according to the embodiment of the present disclosure may include an outer wall 110 (which may be referred to as a "first wall"), and an inner wall 114 (which may be referred to as a "second wall") which is located at an inside of the outer wall 110 to be spaced from the outer wall 110.

The outer wall 110 may include a plurality of first flame holes 112 through which the flame is discharged. The plurality of first flame holes 112 may be disposed to be spaced in a circumferential direction of the outer wall 110.

The inner wall 114 may include a plurality of second flame holes 116 through which the flame is discharged. The plurality of second flame holes 116 may be disposed to be spaced in a circumferential direction of the inner wall 114.

The burner head 10 may further include a bottom wall 118 which forms a mixed gas chamber 120 together with the outer wall 110 and the inner wall 114.

The burner cap 30 may be seated on the outer wall 110 and the inner wall 114. And the burner cap 30 may cover the mixed gas chamber 120. At this time, the burner cap 30 may include an opening 31 so that the flame generated at the inner wall 114 passes through the burner cap 30. For example, the opening 31 may be formed at a center portion of the burner cap 30.

One or more mixed gas supply pipes 130 and 131 may be connected to the bottom wall 118. The mixed gas supply pipes 130 and 131 may be integrally formed with the bottom wall 118, or may be separately formed from the bottom wall 118 and then may be coupled to the bottom wall 118.

The outer wall 110 and the inner wall 114 may be connected by a plurality of connection walls 121 and 122.

Each of the outer wall 110 and the inner wall 114 may be formed to have an approximately "C" shape when seen from an upper side, and an end of the inner wall 114 and an end of the outer wall 110 may be connected by the plurality of connection walls 121 and 122.

The plurality of connection walls 121 and 122 may include a first connection wall 121 and a second connection wall 122 which is spaced from the first connection wall 121.

The first connection wall 121 may connect one end of the outer wall 110 with one end of the inner wall 114. The second connection wall 122 may connect the other end of the outer wall 110 with the other end of the inner wall 114. Therefore, the mixed gas chamber 120 may also be formed to have an approximately "C" shape when seen from an upper side.

The first connection wall 121 and the second connection wall 122 are disposed to be spaced a predetermined distance from each other, and thus define a flame spread passage 126 for spreading the flame.

The flame spread passage 126 may spread the flame of the outer wall 110 toward the inner wall 114, or may spread the flame of the inner wall 114 toward the outer wall 110.

The burner head 10 may further include a passage bottom wall 125 for forming a bottom of the flame spread passage 126.

An ignition part through-hole 134 through which the ignition part 230 passes may be formed at the passage bottom wall 125.

At least one of the first connection wall 121 and the second connection wall 122 may include an ignition flame hole 127 which supplies the mixed gas to the ignition part 230. The ignition flame hole 127 may be disposed at least one of the first connection wall 121 and the second connection wall 122 to be inclined toward the ignition part 230.

Since the ignition flame hole 127 is disposed to be inclined toward the ignition part 230, and thus the mixed gas is supplied to the ignition part 230 when an igniting operation is performed by the ignition part 230, the igniting operation is rapidly and smoothly performed.

At least one of the first and second connection walls 121 and 122 may include a flame spread hole 128 which supplies the mixed gas to be stayed in the flame spread passage 126. The flame spread hole 128 may be located closer to the inner wall 114 than the ignition flame hole 127.

The burner head 10 may further include a rib 129 which allows the mixed gas supplied to the flame spread passage 126 to be stayed in the flame spread passage 126.

The rib 129 may extend upward from the passage bottom wall 125. That is, the rib 129 may extend from the passage bottom wall 125 toward the burner cap 30.

The rib 129 may minimize the flow of the mixed gas in the flame spread passage 126 into an inner space of the inner wall 114.

To spread the flame between the outer wall 110 and the inner wall 114, the rib 129 may connect both ends of the inner wall 114. That is, the both ends of the inner wall 114 are spaced from each other, and the rib 129 may connects the both ends of the inner wall 114.

Therefore, by the rib 129, the mixed gas supplied into the flame spread passage 126 may be stayed in the flame spread passage 126, and thus the flame may be smoothly spread between the outer wall 110 and the inner wall 114.

According to the embodiment, even when a calorific value (a quantity of heat which can be provided by the burner) of the burner 1 is small as well as when the calorific value is great, the mixed gas may be stayed in the flame spread passage 126, and thus the flame may be smoothly spread between the outer wall 110 and the inner wall 114.

In particular, since the flame is smoothly spread in a state in which the flame of the inner wall 114 and the outer wall 110 is extinguished, the unburned mixed gas is prevented from being discharged to an outside.

As another example, the rib 129 may connect the first connection wall 121 with the second connection wall 122. However, to secure a space in the flame spread passage 126, the rib 129 may be located adjacent to the inner wall 114.

A height of the rib 129 may be lower than that of the inner wall 114. If the height of the rib 129 is the same as that of the inner wall 114, the rib 129 may effectively prevent the mixed gas in the flame spread passage 126 from being discharged to the inner space of the inner wall 114, but the mixed gas in the flame spread passage 126 does not meet the flame of the inner wall 114. Therefore, the flame is not spread to the outer wall 110, and thus it is not preferable (when the flame of the outer wall is extinguished).

Also, when the height of the rib 129 is the same as that of the inner wall 114, the flame of the flame spread passage 126 does not meet the mixed gas discharged from the second flame hole 116 of the inner wall 114. Therefore, the flame is not spread to the inner wall 114, and thus it is not preferable (when the flame of the inner wall is extinguished).

Also, when the height of the rib 129 is higher than that of the inner wall 114, it is difficult to seat the burner cap 30 on the inner wall 114, or a part of the burner cap 30 is spaced from the inner wall 114.

That is, it is preferable that the rib 129 be spaced from a lower surface of the burner cap 30, while the burner cap 30 is seated on the burner head 10.

Meanwhile, at least a part of the ignition part 230 may be located between the first connection wall 121 and the second connection wall 122, while passing through the ignition part through-hole 134.

Since at least a part of the ignition part 230 is located between the first connection wall 121 and the second connection wall 122, the ignition part 230 serves as a wall which prevents the mixed gas in the flame spread passage 126 from flowing to an outside of the outer wall 110, and thus the mixed gas supplied into the flame spread passage 126 may be stayed in the flame spread passage 126.

Meanwhile, the burner head 10 may further include a flame staying chamber 140 which provides a space allowing the flame to be stayed therein.

The flame staying chamber 140 may be formed by recessing a part (hereinafter, call a "chamber defining wall") of the outer wall 110 toward the inner wall 114. One or more slit 143 may be formed at the chamber defining wall 142.

The chamber defining wall 142 may be connected to the inner wall 114, or may not be connected with the inner wall 114. When the chamber defining wall 142 is not connected to the inner wall 114, the mixed gas may flow between the inner wall 114 and the chamber defining wall 142.

By the flame staying chamber 140, the flame may be stayed in the flame staying chamber 140, even though the flame of the outer wall 110 and the inner wall 114 is extinguished while the burner 1 is used, and thus the mixed gas in the outer wall 110 and the inner wall 114 may be reignited by the flame in the flame staying chamber 140, thereby generating the flame.

In particular, when the burner 1 is used while being installed at a gas oven range, or the gas oven range is used in a built-in state, the flame of the inner wall 114 and the outer wall 110 of the burner 1 may be extinguished while an oven door of the gas oven range is opened and closed.

Even in this case, the mixed gas in the outer wall 110 and the inner wall 114 may be reignited by the flame in the flame staying chamber 140, and thus the flame may be generated.

At this time, the flame may be generated at the outer wall 110 by the flame in the flame staying chamber 140, and the flame generated from the outer wall 110 is transferred to the flame spread passage 126. As described above, since the mixed gas may be stayed in the flame spread passage 126 by the rib 129, the flame of the flame spread passage 126 may be smoothly transferred toward the mixed gas discharged from the second flame hole 116 of the inner wall 114, and thus may be spread to the inner wall 114.

The burner head 10 may have an air hole 111 through which external air flows toward the second flame hole 116. The air hole 111 may be located at a center portion of the burner head 10.

The burner head 10 may further include a staying guide 150 which allows the mixed gas to be stayed in the inner space of the inner wall 114. The staying guide 150 may protrude from an inner circumferential surface **114*a* of the inner wall 114 toward a center of the burner head 10. Therefore, a thickness of a lower wall thereof in which the staying guide 150 is formed is thicker than that of an upper wall of the inner wall 114 in which the second flame hole 116** is formed.

The staying guide 150 may extend from the inner circumferential surface **114*a* of the inner wall 114** in a circumferential direction.

An upper surface 151 of the staying guide 150 may be located lower than an upper surface of the inner wall 114. Preferably, the upper surface 151 of the staying guide 150 may be located lower than a lowest point **116*a* of the second flame hole 116**.

The upper surface 151 of the staying guide 150 may be located higher than the bottom wall 118 of the mixed gas chamber 120.

The mixed gas supplied to the mixed gas chamber 120 may pass through the second flame hole 116, and may be stayed on the upper surface 151 of the staying guide 150.

At this time, to allow the mixed gas to be stably stayed at an upper side of the staying guide 150, the lower surface of the burner cap 30 may be located at a vertical upper side of the staying guide 150, while the burner cap 30 is seated on the burner head 10. That is, the upper surface 151 of the staying guide 150 may be disposed to be vertically overlapped with the burner cap 30. Therefore, the mixed gas may be stayed at a space between the upper surface 151 of the staying guide 150 and the lower surface of the burner cap 30. At this time, to dispose the upper surface 151 of the staying guide 150 to be vertically overlapped with the burner cap 30, a diameter of the opening 31 of the burner cap 30 may be formed smaller than that of a portion of the inner wall 114 in which the staying guide 150 is formed.

The mixed gas stayed on the upper surface 151 of the staying guide 150 serves so that the flame is smoothly spread between the plurality of second flame holes 116 of the inner wall 114.

At this time, a protruding width W of the staying guide 150 from the inner wall 114 may be 0.6 mm or more. When the protruding width of the staying guide 150 is less than 0.6 mm, the staying guide 150 may not provide a sufficient space in which the mixed gas is stayed, and thus the mixed gas may be substantially hardly stayed on the staying guide 150, and flame spread performance may not be enhanced.

Also, the protruding width W of the staying guide 150 may be 2 mm or less. When the protruding width W of the staying guide 150 is more than 2 mm, an amount of the mixed gas stayed on the upper surface 151 of the staying guide 150 may be increased, but the mixed gas stayed on the upper surface 151 of the staying guide 150 may block air (secondary air) which will flow toward the second flame hole 116 through the air hole 111, and thus there is a problem that a generation amount of the carbon monoxide is increased.

Also, in the case in which the protruding width W of the staying guide 150 is more than 2 mm, when the calorific value of the burner 1 is great (in the case of the large calorific value), the flame between the two adjacent flame holes 116 is connected by the mixed gas stayed at the upper side of the staying guide 150, and a agglomeration phenomenon occurs between the flame, and thus there is a problem that a generation amount of the carbon monoxide is increased.

A distance D between the upper surface 151 of the staying guide 150 and the lowest point 116*a* of the second flame hole 116 may be 0.5 mm or more.

When the distance D between the upper surface 151 of the staying guide 150 and the lowest point 116*a* of the second flame hole 116 is less than 0.5 mm, the amount of the mixed gas stayed on the upper surface 151 of the staying guide 150 is very small, and thus the flame spread performance is not enhanced.

The distance D between the upper surface 151 of the staying guide 150 and the lowest point 116*a* of the second flame hole 116 may be 2 mm or less. When the distance D between the upper surface 151 of the staying guide 150 and the lowest point 116*a* of the second flame hole 116 is more than 2 mm, the mixed gas stayed on the upper surface 151 of the staying guide 150 may not spread the flame between the two adjacent second flame holes 116.

Figure 5:
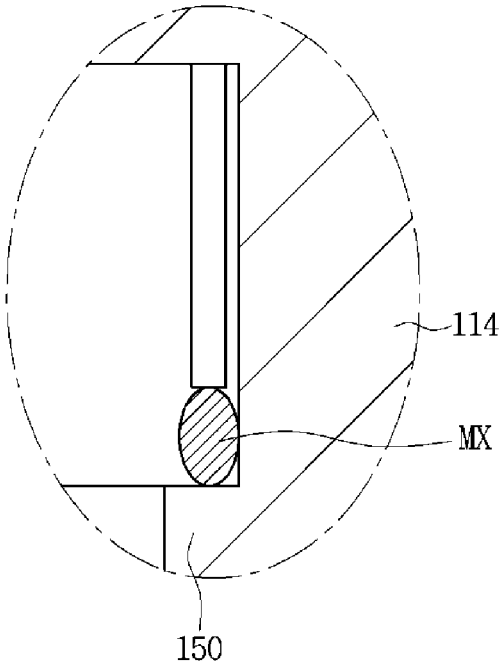
FIG. 5 is a view illustrating a state in which a mixed gas is stayed in a staying guide of the burner head according to the embodiment of the present disclosure.
Figure 6:
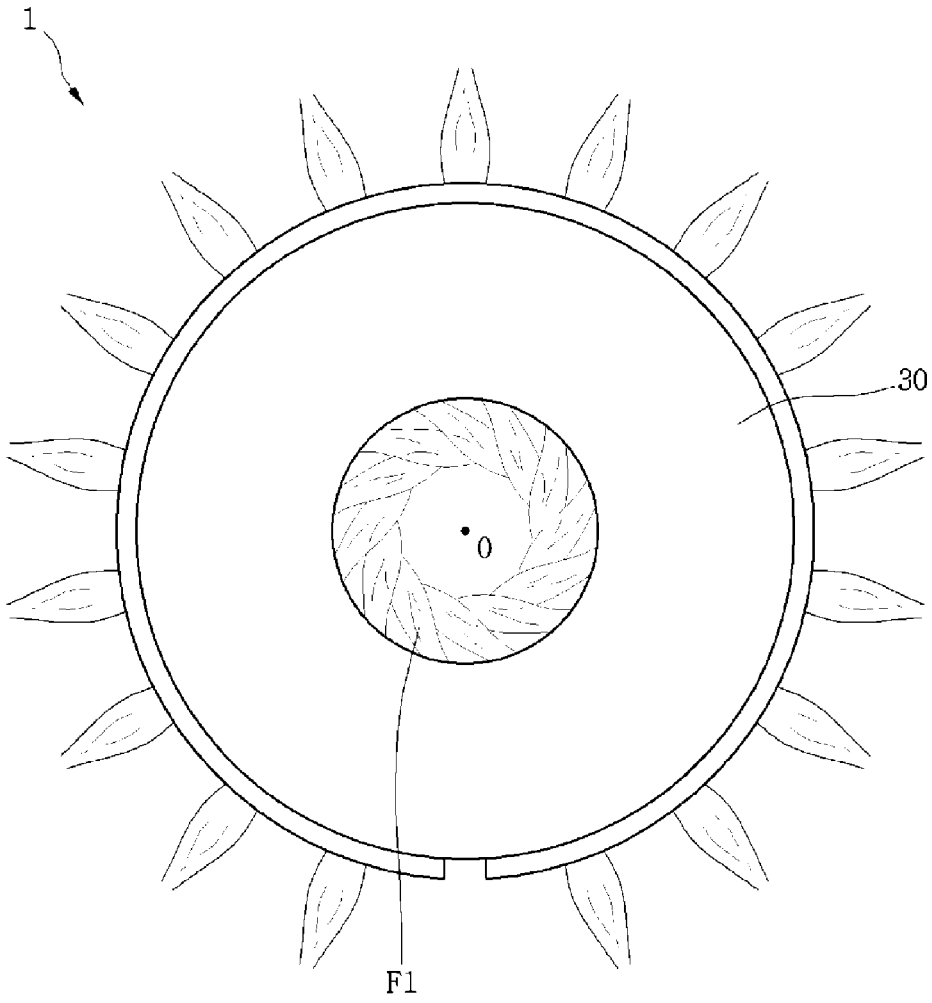
FIG. 6 is a view illustrating a state in which a flame is generated at the burner according to the embodiment of the present disclosure.
Figure 7:
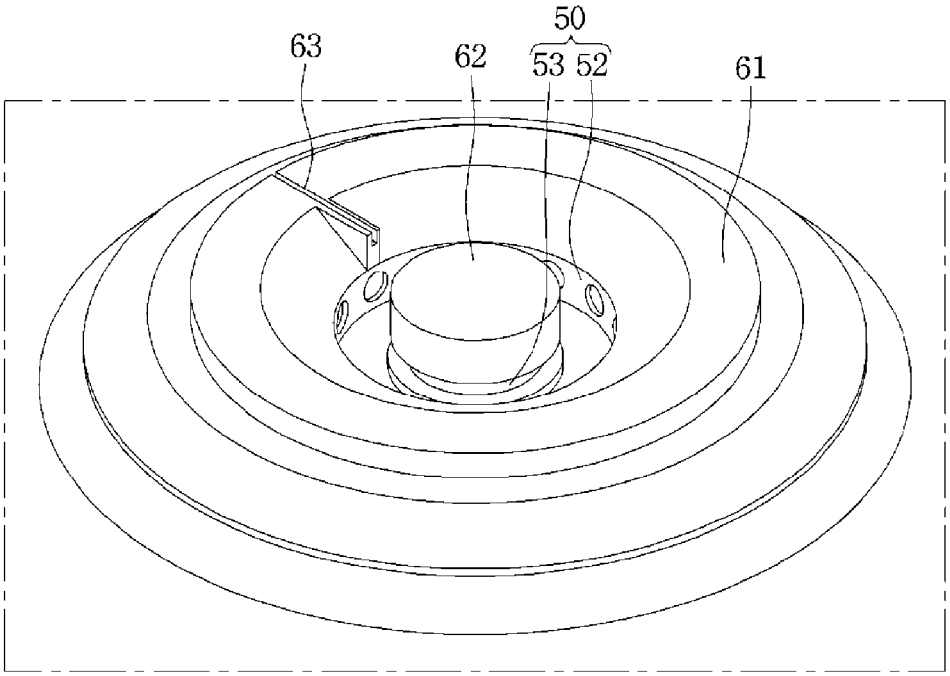
Fig.7 PRIOR ART
FIG. 7 is a perspective view of a burner according to the related art.

FIG. 5 is a view illustrating a state in which the mixed gas is stayed in a staying guide of the burner head according to the embodiment of the present disclosure, and FIG. 6 is a view illustrating a state in which the flame is generated at the burner according to the embodiment of the present disclosure.

Referring to FIGS. 3 to 6, the mixed gas MX introduced into the mixed gas chamber 120 may pass through the second flame hole 116, and may be stayed on the staying guide 150 in the inner space of the inner wall 114.

The flame ignited at the ignition flame hole 127 of the connection walls 121 and 122 by the ignition part 230 is sequentially spread along the first flame hole 112 of the outer wall 110.

Also, the flame ignited at the ignition flame hole 127 is transferred toward one of the plurality of second flame holes 116 of the inner wall, which is adjacent to the connection walls 121 and 122. At this time, the flame spread to the second flame hole 116 may be smoothly spread to the adjacent second flame hole 116 by the mixed gas MX stayed at the upper side of the staying guide 150.

As described above, when the flame is extinguished at the inner wall 114 or the outer wall 110, the flame of the flame staying chamber 140 is spread toward the flame spread passage 126 and the inner wall 114, and the flame spread to the inner wall 114 may be spread to the plurality of flame holes 116 by the mixed gas MX.

Also, in the case in which the burner 1 is operated to have the small calorific value, even though an amount and a flow rate of the mixed gas supplied to the second flame holes 116 are low, the mixed gas MX may be stayed in the staying guide 150, and thus the flame may be smoothly spread among the plurality of second flame holes 116.

To further smoothly spread the flame between the second flame holes 116 by the mixed gas MX on the staying guide 150, an extending direction of each second flame hole 116 may be inclined with respect to an imaginary line connecting the inner wall 114 with a center O of the burner 1 and perpendicular to the inner wall 114.

Therefore, the flame F1 generated at each of the plurality of second flame holes 116 is generated in a direction inclined with respect to the imaginary line, and thus the flame may be further smoothly spread between the second flame holes 116.

Meanwhile, the staying guide 160 may be additionally provided at an outer circumferential surface of the outer wall 110. That is, the staying guide 160 may protrude from the outer circumferential surface of the outer wall 110 to an outside thereof, and the upper surface of the staying guide 160 may be located lower than an outermost end 112*a* of the first flame hole 112 of the outer wall 110.

Even though all the elements of the embodiments are coupled into one or operated in the combined state, the present disclosure is not limited to such an embodiment. That is, all the elements may be selectively combined with each other without departing the scope of the invention. Furthermore, when it is described that one comprises (or comprises or has) some elements, it should be understood that it may comprise (or include or have) only those elements, or it may comprise (or include or have) other elements as well as those elements if there is no specific limitation. Unless otherwise specifically defined herein, all terms comprising technical or scientific terms are to be given meanings understood by those skilled in the art. Like terms defined in dictionaries, generally used terms needs to be construed as meaning used in technical contexts and are not construed as ideal or excessively formal meanings unless otherwise clearly defined herein.

Although embodiments have been described with reference to a number of illustrative embodiments thereof, it will be understood by those skilled in the art that various changes in form and details may be made therein without departing from the scope of the invention as defined by the appended claims. Therefore, the preferred embodiments should be considered in descriptive sense only and not for purposes of limitation, and also the technical scope of the invention is not limited to the embodiments. Furthermore, is defined not by the detailed description of the invention but by the appended claims, and all differences within the scope will be construed as being comprised in the present disclosure.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A burner comprising:

a burner head to receive a mixed gas; and a burner cap to cover the burner head, wherein the burner head comprises:

an outer wall having a plurality of first flame holes, an inner wall spaced from the outer wall and having a plurality of second flame holes, and a mixed gas chamber formed between the outer wall and the inner wall, and a staying guide provided at an inner circumferential surface of the inner wall to allow the mixed gas flowing from the mixed gas chamber to be stayed thereon, wherein an upper surface of the staying guide is lower than an upper surface of the inner wall, and wherein the upper surface of the staying guide is lower than lowest points of the plurality of second flame holes.

2. The burner of claim 1, wherein the staying guide protrudes from the inner circumferential surface of the inner wall, and extends along the entire inner circumferential surface of the inner wall.

3. The burner of claim 1, wherein a thickness of a lower portion of the inner wall circumferential surface in which the staying guide is formed is thicker than that of an upper portion of the inner wall circumferential surface in which the plurality of second flame holes are formed.

4. The burner of claim 1, wherein the upper surface of the staying guide is higher than a bottom wall of the mixed gas chamber.

5. The burner of claim 1, wherein an extending direction of each of the plurality of second flame holes is inclined with respect to an imaginary line connecting the inner wall with a center of the burner and perpendicular to the inner wall.

6. The burner of claim 1, wherein the upper surface of the staying guide is disposed to be vertically overlapped with the burner cap.

7. The burner of claim 1, wherein the burner head comprises an air hole through which air passes, and the burner cap comprises an opening through which the air passes.

8. The burner of claim 7, wherein a diameter of the opening is smaller than that of a portion of the inner wall in which the staying guide is formed.

9. The burner of claim 8, wherein the burner cap covers the flame spread passage.

10. The burner of claim 1, further comprising:

a first connection wall to connect the inner wall with the outer wall, a second connection wall to connect the inner wall with the outer wall and to be spaced from the first connection wall, and a flame spread passage defined between the first and second connection walls to spread the flame between the inner wall and the outer wall.

11. The burner of claim 10, wherein the flame spread passage includes a bottom wall having an ignition part through-hole.

12. The burner of claim 11, wherein the ignition part through-hole accommodates an ignition part.

13. The burner of claim 10, wherein at least one of the first connection wall and the second connection wall includes an ignition flame hole supplying the mixed gas to an ignition part.

14. The burner of claim 10, wherein at least one of the first connection wall and the second connection wall includes a flame spread hole supplying the mixed gas to the flame spread passage, to maintain a flame.

15. The burner of claim 1, further comprising:

an additional staying guide to protrude from an outer circumferential surface of the outer wall and to allow the mixed gas flowing from the mixed gas chamber to be stayed thereon.

16. The burner of claim 15, wherein an upper surface of the additional staying guide is located lower than an outermost end of the first flame hole of the outer wall.

17. The burner of claim 1, further comprising:

a flame staying chamber, formed by walls recessed from the outer wall towards the inner wall, to maintain a flame.

18. The burner of claim 17, wherein the flame staying chamber includes slits formed in the recessed wall connecting to the mixed gas chamber.

* * * * *